US012516839B2

(12) United States Patent
Mantalwad et al.

(10) Patent No.: US 12,516,839 B2
(45) Date of Patent: Jan. 6, 2026

(54) VENTILATION AIR VALVE, AND AIR CONDITIONING UNIT THEREOF

(71) Applicant: TRANE INTERNATIONAL INC., Davidson, NC (US)

(72) Inventors: Venkatesh Narsingrao Mantalwad, Nashville, TN (US); Max L. Coombs, La Crosse, WI (US); Scott Hall, La Crosse, WI (US); Sierra Jacobs, La Crosse, WI (US); Mel Aklile, La Crosse, WI (US); Lane A. Liudahl, Holmen, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 44 days.

(21) Appl. No.: 18/488,693

(22) Filed: Oct. 17, 2023

(65) Prior Publication Data

US 2025/0123033 A1 Apr. 17, 2025

(51) Int. Cl.
*F24F 11/36* (2018.01)
*F25B 49/00* (2006.01)

(52) U.S. Cl.
CPC ..... *F24F 11/36* (2018.01); *F25B 49/005* (2013.01); *F25B 2500/222* (2013.01)

(58) Field of Classification Search
CPC ..... F24F 11/36; F25B 2500/222
See application file for complete search history.

(56) References Cited

U.S. PATENT DOCUMENTS

| | | | | |
|---|---|---|---|---|
| 6,536,225 | B1 * | 3/2003 | Yajima | F24F 1/022 62/407 |
| 8,695,404 | B2 | 4/2014 | Kadle et al. | |
| 10,254,030 | B2 * | 4/2019 | Kawashima | F25B 13/00 |
| 10,539,358 | B2 | 1/2020 | Suzuki et al. | |
| 10,935,454 | B2 | 3/2021 | Kester | |
| 11,041,647 | B2 * | 6/2021 | Weinert | F24F 11/79 |
| 11,092,566 | B2 | 8/2021 | Chen et al. | |
| 11,098,915 | B2 | 8/2021 | Crawford | |
| 11,125,457 | B1 | 9/2021 | Alfano et al. | |
| 11,280,507 | B2 * | 3/2022 | Yoneyama | F24F 11/36 |
| 11,703,240 | B2 | 7/2023 | Hansen et al. | |
| 11,835,244 | B2 * | 12/2023 | Lord | F24F 11/36 |
| 2013/0098576 | A1 * | 4/2013 | Fujitaka | F24F 11/46 165/11.1 |
| 2021/0108819 | A1 | 4/2021 | Chen et al. | |

(Continued)

*Primary Examiner* — Christopher R Zerphey
(74) *Attorney, Agent, or Firm* — HSML P.C.

(57) ABSTRACT

An air conditioning unit includes a housing, a partition disposed in the housing, a refrigerant circuit, a blower, an air valve, and a refrigerant leak detection system configured to detect a refrigerant leak within the air conditioning unit. The housing includes a first compartment and a second compartment, and the partition separates the first compartment and the second compartment. The refrigerant circuit disposed in the first compartment. The air valve extending through the partition or through the housing to the second compartment. The air valve configured to open in response to the refrigerant leak detection system detecting the refrigerant leak. A method of ventilating an air conditioning unit includes detecting, via a refrigerant leak detection system, for a refrigerant leak within the air conditioning unit, and in response to detecting the refrigerant leak, opening an air valve.

15 Claims, 6 Drawing Sheets

(56) References Cited

U.S. PATENT DOCUMENTS

| | | | | |
|---|---|---|---|---|
| 2021/0123624 | A1 | 4/2021 | Kronstrom et al. | |
| 2022/0018580 | A1* | 1/2022 | Kim | F24F 11/36 |
| 2022/0252304 | A1 | 8/2022 | Green | |
| 2022/0397295 | A1 | 12/2022 | Sadanandan et al. | |
| 2023/0003404 | A1* | 1/2023 | Steen | F24F 11/0001 |
| 2023/0213254 | A1 | 7/2023 | Ma | |
| 2023/0243533 | A1 | 8/2023 | Kronstrom et al. | |
| 2023/0296286 | A1* | 9/2023 | Yajima | F24F 1/38 62/259.1 |
| 2025/0123014 | A1* | 4/2025 | Mantalwad | F24F 13/02 |

* cited by examiner

VENTILATION AIR VALVE, AND AIR CONDITIONING UNIT THEREOF

FIELD

This disclosure relates to air conditioning units used in heating, ventilation, air conditioning, and refrigeration ("HVACR") systems. More particularly, this disclosure relates to such air conditioning units that contain multiple compartments.

BACKGROUND

HVACR systems are generally used to heat, cool, and/or ventilate an enclosed space (e.g., an interior space of a commercial building or a residential building, an interior space of a refrigerated transport unit, or the like). In some configurations, an air conditioning unit may be constructed to contain multiple compartments which include the different mechanical components of the air conditioning unit (e.g., compressor, blower, evaporator, condenser, or the like). For example, the compartments may be utilized to separate the different mechanical components from each other and/or to provide a separate internal spaces for directing and conditioning air (e.g., cooling air, heating air, or the like).

SUMMARY

In an embodiment, an air conditioning unit includes a housing with a first compartment and a second compartment, a partition disposed in the housing, a refrigerant circuit, a blower, an air valve, and a refrigerant leak detection system configured to detect a refrigerant leak within the air conditioning unit. The partition separates the first compartment and the second compartment. The refrigerant circuit includes a compressor disposed in the first compartment. The blower is configured to direct air to flow through the second compartment. The air valve extends through the partition or through the housing to the second compartment. A controller is configured to open the air valve in response to the refrigerant leak detection system detecting the refrigerant leak.

In an embodiment, the refrigeration circuit includes a first heat exchanger disposed in the second compartment. The first heat exchanger is configured to condition the air flowing through the first compartment.

In an embodiment, the refrigerant leak detection system is configured to detect a concentration of refrigerant and to detect the refrigerant leak when a concentration of refrigerant is at or above a predetermined minimum limit.

In an embodiment, the air valve extends through the partition.

In an embodiment, the air valve extends through the housing to the second compartment.

In an embodiment, the controller is configured to in response to detecting the leaked refrigerant, open the air valve and activate the blower.

In an embodiment, the opening of the air valve causes the blower to suction air from the first compartment into the second compartment.

In an embodiment, the suction by the blower mixes the air from the first compartment with inlet air flowing through the second compartment through a first heat exchanger. The blower is configured to discharge the mixture through an outlet in the housing.

In an embodiment, the controller is configured to operate the air conditioning unit in at least a first mode and a second mode. In the first mode, the air valve is closed and obstructs air from flowing between the first compartment and the second compartment. In the second mode, the air valve is open and the blower is active to discharge any leaked refrigerant present in the first compartment out of the housing through the second compartment.

In an embodiment, in the first mode, the first heat exchanger conditions inlet air directed through the second compartment by the blower.

In an embodiment, the air valve is one of a butterfly valve, a gate valve, and an umbrella valve.

In an embodiment, a method is directed to ventilating an air conditioning unit. The method includes directing, with a blower, air to pass through a blower compartment of a housing of the air conditioning unit, which includes the air flowing into the blower compartment through a first heat exchanger. The housing includes a compressor compartment containing a compressor and the blower compartment containing the blower and the first heat exchanger. A partition is disposed in the housing and separates the compressor compartment and the blower compartment. The method further includes detecting, via a refrigerant leak detection system, for a refrigerant leak within the air conditioning unit, and in response to detecting the refrigerant leak, opening an air valve that one of extends through the partition or through the housing to the compressor compartment.

In an embodiment, the method further includes suctioning, with the blower, any present leaked refrigerant in the compressor into the blower compartment, and discharging, with the blower, a mixture of the air after flowing through the first heat exchanger and the leaked refrigerant suctioned into the second compartment out of the air conditioning unit.

In an embodiment, the detecting, via refrigerant leak detection system, for the refrigerant leak includes sensing, with the one or more concentration sensors, a refrigerant concentration within the housing of the air conditioning unit, and detecting the leaked refrigerant when the sensed refrigerant concentration is at or above a predetermined minimum limit.

In an embodiment, the air valve is disposed in the opening in the partition.

In an embodiment, the air valve is disposed in the partition.

In an embodiment, the method further includes operating the air conditioning unit in a first mode, in which in which the air valve is closed and the first heat exchanger conditioning the air passing through the first heat exchanger, and operating the air conditioning unit in a second mode, in which the air valve is open and that includes activating the blower to discharge any leaked refrigerant present in the first compartment out of the housing through the second compartment.

In an embodiment, the directing, with the blower, of the air to pass through the second compartment is in response to detecting the leaked refrigerant.

DRAWINGS

Like numbers represent like features.

DETAILED DESCRIPTION

Figure 1:
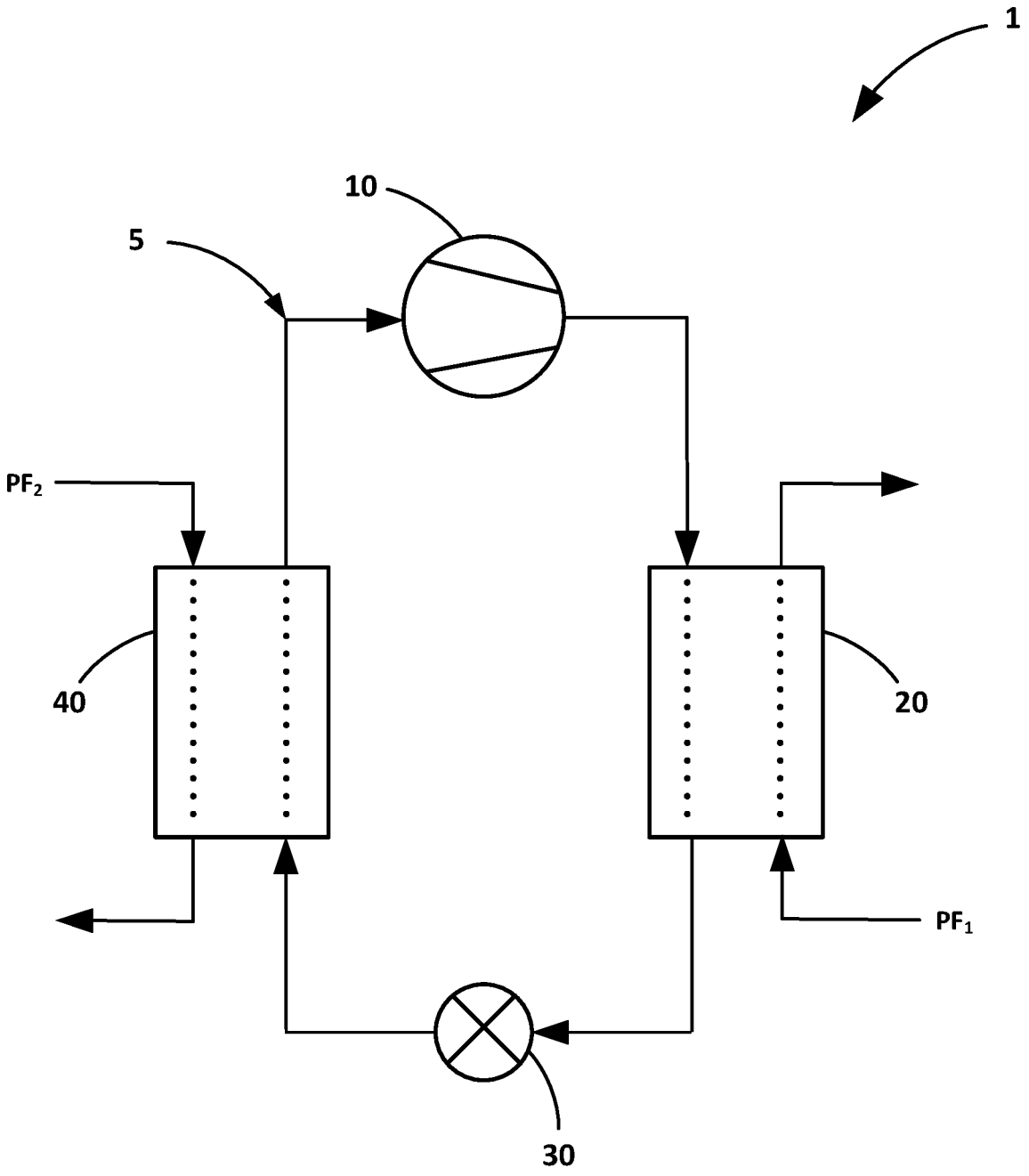
FIG. 1 is a schematic diagram of an embodiment of a refrigerant circuit of a HVACR system.

FIG. 1 is a schematic diagram of an embodiment of a refrigeration circuit 5 in a heating, ventilation, air conditioning, and refrigeration (HVACR) system 1. In an embodiment, the HVACR system 1 may be an industrial or residential HVACR system 1 configured to condition the inside of a building (e.g., office space, residential house, or the like).

The refrigeration circuit 5 includes a compressor 10, a condenser 20, an expansion device 30, and an evaporator 40. In an embodiment, the refrigeration circuit 5 can be modified to include additional components. For example, the refrigeration circuit 5 in an embodiment can include an economizer heat exchanger, one or more flow control devices, a receiver tank, a dryer, a suction-liquid heat exchanger, or the like. The components of the refrigerant circuit 5 are fluidly connected. Dotted lines and dotted dashed lines are provided in the Figures to indicate fluid flows through some components (e.g., compressor 10, condenser 20, evaporator 40) for clarity, and should be understood as not specifying a specific route within each component.

The refrigerant circuit 5 can be configured as a cooling system (e.g., a fluid chiller of an HVACR, an air conditioning system, or the like) that can be operated in a cooling mode, and/or the refrigerant circuit 5 can be configured to operate as a heat pump system that can run in a cooling mode and a heating mode.

The refrigeration circuit 5 applies known principles of gas compression and heat transfer. The refrigeration circuit can be configured to heat or cool a process fluid (e.g., water, air, chiller fluid, or the like). In an embodiment, the refrigeration circuit 5 may represent a chiller that cools a process fluid such as water or the like. In an embodiment, the refrigeration circuit 5 may represent an air conditioner and/or a heat pump that cools and/or heats a process fluid such as air, water, or the like. In an embodiment, the refrigerant circuit 1 may be a heat pump that operates to provide heating and/or cooling.

During the operation of the refrigeration circuit 5, a working fluid (e.g., containing refrigerant, refrigerant mixture, or the like) flows into the compressor 10 from the evaporator 40 in a gaseous state at a relatively lower pressure. The compressor 10 compresses the gas into a high pressure state, which also heats the gas. After being compressed, the relatively higher pressure and higher temperature gas flows from the compressor 10 to the condenser 20. In addition to the working fluid flowing through the condenser 20, a first process fluid $PF_1$ (e.g., external air, external water, cooling water, heater water, or the like) also separately flows through the condenser 20. The first process fluid absorbs heat from the working fluid as the first process fluid $PF_1$ flows through the condenser 20, which cools the working fluid as it flows through the condenser. The working fluid condenses to liquid and then flows into the expansion device 30. The expansion device 30 allows the working fluid to expand, which converts the working fluid to a mixed vapor and liquid state. An "expansion device" as described herein may also be referred to as an expander. In an embodiment, the expander may be an expansion valve, expansion plate, expansion vessel, orifice, or the like, or other such types of expansion mechanisms. It should be appreciated that the expander may be any type of expander used in the field for expanding a working fluid to cause the gaseous working fluid to decrease in pressure and temperature. The relatively lower temperature, vapor/liquid working fluid then flows into the evaporator 40. A second process fluid $PF_2$ (e.g., air, chiller liquid, water, or the like) also flows through the evaporator 40. The working fluid absorbs heat from the second process fluid $PF_2$ as it flows through the evaporator 40, which cools the second process fluid $PF_2$ as it flows through the evaporator 40. As the working fluid absorbs heat, the working fluid evaporates to vapor. The working fluid then returns to the compressor 10 from the evaporator 40. The above-described process continues while the refrigeration circuit 5 is operated, for example, in a cooling mode.

Figure 2:
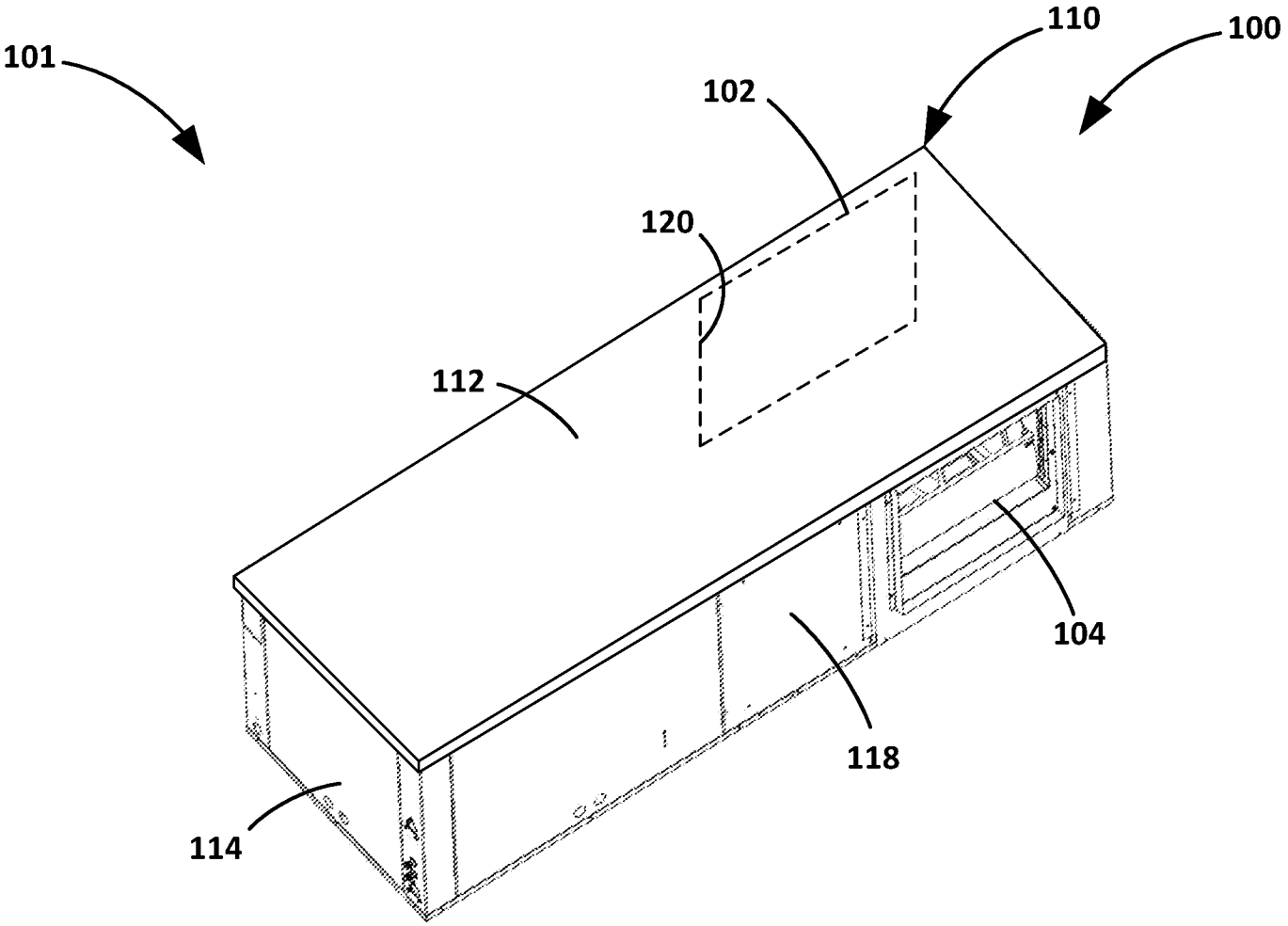
FIG. 2 is a top perspective view of an embodiment of an air conditioning unit.

FIG. 2 is a top perspective view of an air conditioning unit 100, according to an embodiment. In an embodiment, the air conditioning unit 100 is for a heating, ventilation, air conditioning, and refrigeration (HVACR) system 101. The air conditioning unit 100 includes a housing 110 having a plurality of sides 112, 114, 116, 118, 120, 122 (sides 116, 120, 122 are obscured in FIG. 2). The sides may also be referred to as a top side 112, a left side 114, a right side 116, a front side 118, a rear side 120, and a bottom side 122. The components of the air conditioning unit 100 are disposed within the housing 110. In an embodiment, the housing 110 is the external housing of the air conditioning unit 100.

The air conditioning unit 100 includes an inlet 102 and an outlet 104 formed in the housing 110. For example, the inlet 102 is formed in a first side 120 (e.g., rear side) of the housing 110 and the outlet 104 is formed in a second side 118 (e.g., front side) of the housing 110. Air is suctioned into the air conditioning unit 100 through the inlet 102, is conditioned (e.g., heated, cooled, or the like) within the air conditioning unit 100, and is discharged (as conditioned air) from the outlet 104. It should be appreciated that the inlet 102 and the outlet 104 may be formed in different sides 112, 116, 118, 120, 122 of the housing 110 than is shown in FIG. 3.

Figure 3:
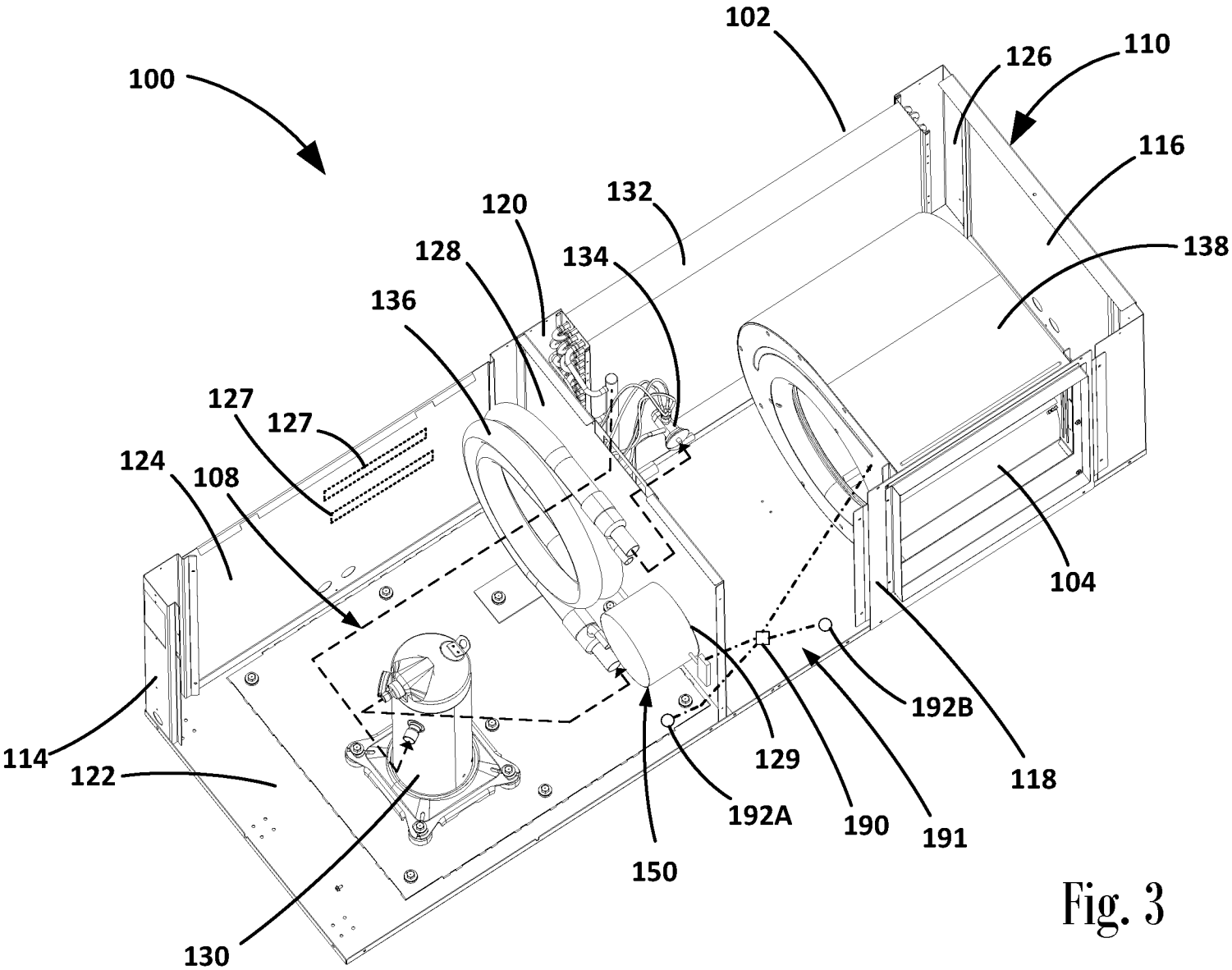
FIG. 3 is a top perspective view of the air conditioning unit in FIG. 2 with a top side omitted and a left side and a front side partially omitted, according to an embodiment.

FIG. 3 is a top perspective view of the air conditioning unit 100 with the top side 118 omitted and the left side 114 and the front side 118 partially omitted, according to an embodiment. The air conditioning unit 100 includes a refrigerant circuit 108 that operates to provide conditioning to the air flowing through the air conditioner unit 100 (e.g., refrigerant in the refrigerant circuit 108 being used to heat and/or cool the air). For example, the refrigerant circuit 108 can be the refrigerant circuit 5 in FIG. 1. For example, the air conditioning unit 100 can be included in a HVACR system (e.g., as part of the (HVACR) system 1 in FIG. 1). In an embodiment, the refrigerant circuit 108 may be modified as discussed above with respect to the refrigerant circuit 5 in FIG. 1.

As shown in FIG. 3, the air conditioner unit 100 includes a compressor 130, a first heat exchanger 132, an expander 134, and a second heat exchanger 136 fluidly connected (e.g., in series). The refrigerant circuit 108 includes the compressor 130, the first heat exchanger 132, the expander 134, and the second heat exchanger 136 (e.g., are components of the refrigerant circuit 108). The first heat exchanger 132 is an air heat exchanger that conditions the air flowing through the air conditioning unit 100 (e.g., the refrigerant cools/heats the air flowing through the first heat exchanger 132).

In an embodiment, the refrigerant circuit may be reversible (e.g., having reversing valve(s) to switch between operating in a cooling mode and a heating mode). In a cooling mode, the first heat exchanger 132 can operate as an evaporator that cools the air flowing through first heat exchanger 132 (e.g., refrigerant cools the air); and the second heat exchanger 136 can operate as a condenser that cools and condenses (e.g., partially condense, fully condense) the refrigerant (e.g., refrigerant is cooled with water in FIG. 3). In a heating mode, the first heat exchanger 132 can operate as a condenser that heats the air flowing through the first heat exchanger 132; and the second heat exchanger 136 can operate as an evaporator that heats the refrigerant (e.g., refrigerant is heated/evaporated with water in FIG. 3).

Refrigerant conduits (e.g., pipes, tubes, and the like) between different components in the refrigerant circuit 108 in FIG. 3 (e.g., between the compressor 130 and the heat exchangers 132, 136, between the first heat exchanger 132 and the expander 134) are simplified as dashed arrows for illustrative purposes. For example, the direction on the dashed arrows are for a flow direction when the refrigerant circuit 108 is operating in a cooling mode. The process fluid inlet and outlet conduits for the second heat exchanger 136 (e.g., to supply water to and from the second heat exchanger 136 in FIG. 3) are also omitted from FIG. 3.

The housing 110 includes a plurality of compartments 124, 126. For example, each compartment 124, 126 is a different enclosed volume within the housing 110. The compartments 124, 126 are each defined by the housing 110 (e.g., at least partially defined by the sides 112, 114, 116, 118, 120, 122 of the housing 110). As shown in FIG. 3, the housing includes a first compartment 124 and a second compartment 126.

The air conditioning unit 100 includes a partition 128 disposed within the housing 110. The first compartment 124 and the second compartment 126 are separated from each other within the housing 110 by the partition 128. As shown in FIG. 3, the second compartment 126 is adjacent to the first compartment 124. In the illustrated embodiment, the first compartment 124 and the second compartment 126 are disposed on opposite surfaces of the partition 128. It is appreciated that the housing 100 can include additional compartment(s) or volume(s) disposed therein. It should also be appreciated that the compartments 124, 126 may be further divided into smaller volumes in some embodiments.

The partition 128 is configured to restrict and control air flow from the first compartment 124 to the second compartment 126. For example, air in the first compartment 124 can be heated by the operation of the compressor 130. By restricting airflow to the second compartment, convective heat exchange between the first compartment 124 and the second compartment 126 may be reduced or eliminated. In an embodiment, the partition 128 can be configured to extend to, and/or coupled with, the sides 112, 118, 120, and 122 of the housing 110.

The first compartment 124 can be a compartment in the housing 110 that contains the compressor 130, the expander 132, and/or the second heat exchanger 136. In the illustrated embodiment, the first compartment 124 contains the compressor 130 (e.g., the compressor 130 is disposed within the first compartment 124) and can be referred to as a compressor compartment. As shown in FIG. 3, the second heat exchanger 136 can be also disposed in the first compartment 124. As shown in FIG. 3, the first compartment 124 can be provided/defined by the partition 128 and a plurality of the sides of the housing 110 (e.g., by the partition 128 and the sides 112, 114, 118, 120, 122).

The air conditioning unit 100 includes the blower 138 that directs air to flow through the housing 110 from the inlet 102 to outlet 104. The second compartment 126 can include the blower 138 (e.g., the blower 138 is disposed within the second compartment 126) and can be referred to as a blower compartment. As shown in FIG. 3, the first heat exchanger 132 can also be disposed in the second compartment 126. As shown in FIG. 3, the second compartment 126 can be provided/defined by the partition 128 and a plurality of the sides of the housing 110 (e.g., by the partition 128 and the sides 112, 116, 118, 120, 122). The second compartment 126 can be a compartment in the housing 110 that contains an air flow path for receiving and conditioning the inlet air by the first heat exchanger 132 and providing the conditioned air. The conditioned air can be sent to the climate controlled space.

The refrigerant circuit 108 is disposed in the first compartment 124. For example, the refrigerant circuit 108 has one or more of components disposed in the first compartment 124 (e.g., compressor 130 disposed in the first compartment 124, second heat exchanger disposed in the first compartment 124). The refrigerant circuit 108 may also be disposed in the second compartment 126. For example, the refrigerant circuit 108 has one or more components disposed in the second compartment 126 (e.g., second heat exchanger 136 disposed in the second compartment 126, expansion valve 134 disposed in the second compartment 126).

The blower 138 suctions air into the housing 110 through the air inlet 102 and discharges air from the housing through the air outlet 104. The air inlet 102 and the air outlet 104 are openings formed in the housing 110. The air flow passes through the first heat exchanger 132 as it flows into the housing 110 via the air inlet 102. In a cooling mode, the refrigerant and the air exchange heat within the first heat exchanger/evaporator 132 (without physically mixing) as the refrigerant and air each separately flow through the first heat exchanger/evaporator 132, which heats (e.g., evaporates) the refrigerant and cools the air. The conditioned (e.g., cooled) air then flows into the blower 138 and is discharged through the air outlet 104 of the air conditioning unit 100. The air inlet 102 and the air outlet 104 are also an inlet and an outlet of the first compartment 124. For example, air is conditioned (e.g., cooled in a cooling mode, heated in a heating mode) as the air flows into and through the first compartment 124.

In FIG. 3, the second heat exchanger 136 is a coaxial coil heat exchanger that is configured to condition (e.g., the refrigerant is cooled/heated) the refrigerant using water. It should be appreciated that the second heat exchanger 136. It should be appreciated that the second heat exchanger 136 may be a different type of heat exchanger in other embodiments. In FIG. 3, the second heat exchanger 136 is disposed in the second compartment 126. In the illustrated embodiment, the second heat exchanger 136 is configured to heat water with the (relatively hotter) refrigerant discharged from the compressor 130, which cools and condenses the refrigerant. In an embodiment, the second heat exchanger 136 may be disposed external from the air conditioning unit 100. For example, the second heat exchanger 136 may be in the form of an evaporative condenser located remote from the air conditioning unit 100 (e.g., a cooling tower that cools refrigerant from a plurality of air conditioning units, a remote air-cooled condenser, or the like).

Generally, the partition 128 is configured to limit (e.g., restrict) air flow between the first compartment 124 and the second compartment 126 (e.g., air flow from the first compartment 124 to the second compartment 126). For example, air within the compressor/first compartment 124 can be heated by the operation of the compressor 130, and flow of the heated air into the blower compartment 126 can increase a temperature of the air in the blower compartment 126. This can cause decreased performance and decreased efficiency of the air conditioning unit 100. The partition 128 is configured to help limit air flow between the two compartments 124, 126 to reduce or prevent such deceased performance. In an embodiment, the partition 128 can be configured to extend to, and/or coupled with, the sides 112, 118, 120, and 124 of the housing 110.

The air conditioning unit 100 includes an air valve 150 that extends through the partition 128. The air valve 150 is provided in an opening 129 in the partition 128. The air valve 150 has an open position and a closed position. The air valve 150 can include a valve housing 152 (shown in FIG. 4) and a valve body 154 (shown in FIG. 4). In the closed position, a valve body 154 blocks/obstructs flow through the valve housing 152. For example, the open air valve 150 provides a passageway through the partition 128. In the open position, the valve body 154 allows air to flow through the valve housing 152 (e.g., forms an open pathway through the valve housing 152).

The air valve 150 also includes a motor 156 (shown in FIG. 4) that moves the valve body 154 within the valve housing 152 (e.g., moves between the open and closed positions). In an embodiment, the motor 156 can be an electric motor. In an embodiment, the motor 156 may be an actuator (e.g., electrical actuator, a pneumatic actuator, or the like).

In the illustrated embodiment, the air valve 150 is a butterfly valve. For example, the valve body 154 is turned relative to the valve housing 152 to move between open and closed, in the butterfly valve. In an embodiment the valve housing 152 may be portion of the partition 128.

It should be appreciated that the air valve 150 may be a different type of valve in other embodiments. For example, the air valve 150 in other embodiments may be a gate valve, an umbrella valve, or the like.

In an embodiment, the air valve 150 may be a gate valve in which valve body 154 is a gate (e.g., a door, or the like) that is spring driven, and the motor 156 extends through the gate (e.g., motor 156 is an actuator with an end that extends through the gate). An end of the motor 156 retracts allowing for the spring to drive the gate open. In such an embodiment, a user (e.g., technician, or the like) may reset the gate after it has been opened.

In another embodiment, the air valve 150 may be an umbrella valve. The valve body 154 can be a flexible umbrella valve body, and the actuator 156 may be a linear actuator. For example, in such an embodiment, the linear actuator flexes the flexible umbrella valve body to move the flexible umbrella valve body between the open positon and the closed position that blocks or opens a passageway through the partition 128.

To restrict and control air flow between the first compartment 124 and the second compartment 126, the first compartment 124 and the second compartment 126 are enclosed such that panels (e.g., the housing 110, the sides, the partition 128) are fit with each other forming the first compartment 124 and the second compartment 126 respectively, and air leakage between the two compartments 124, 126 is negligible. For example, the partition 128 is configured to be substantially air tight (e.g., having little to no airflow in between the compartments 124, 126) when the air valve 150 is closed. The air movement between the first compartment 124 and the second compartment 126 is controlled (e.g., by opening or closing the air valve 150).

The air conditioning unit 100 includes a refrigerant leak detection system 191. The refrigerant leak detection system 191 is configured to detect a refrigerant leak within the housing 110. The refrigerant leak detection system 191 may include one or more sensors 192A, 192B. The one or more sensor(s) 192A, 192B are leak detection sensors. Leak detection sensors may include, for example but not limited to, concentration senor(s), performance and/or operation sensor(s), or a combination thereof.

As shown in FIG. 3, the one or more sensor(s) 192A, 192B may include concentration sensor(s) configured to detect for refrigerant in the air. A concentration sensor may be configured to detect refrigerant concentration directly (e.g., by measuring refrigerant concentration in the air) or indirectly (e.g., by measuring oxygen concentration in the air, a decrease in oxygen concentration indicating a corresponding amount of refrigerant in the air).

In the illustrated embodiment, the sensor(s) 192A, 192B can be concentration sensor(s) that are configured to detect for refrigerant within the housing 110 (e.g., detect for leaked refrigerant). The concentration sensor(s) 192A, 192B include a first refrigerant sensor 192A disposed in the compressor compartment 124. The concentration sensor(s) 192A, 192B may also include a second concentration sensor 192B disposed within the blower compartment 126. In an embodiment, the one or both of the concentration sensor(s) 192A, 192B may be disposed closer to the bottom than to the top of the compressor compartment 124.

In another embodiment, the refrigerant leak detection system 91 may be configured to detect a refrigerant leak based on operation of the refrigerant circuit. For example, a decrease in the performance (e.g., efficiency) of the conditioning provided by the air conditioning system may be used to indicate a refrigerant leak. In such embodiments, the sensor(s) 192A, 192B may include one or more of performance sensor(s) 192A. 192B temperature sensor(s), pressure sensor(s), current sensor(s), flow sensor(s), valve position sensor(s) or the like to detect performance of the conditioning of the refrigerant circuit, which can indicate a refrigerant leak.

The refrigerant leak detection system 191 may be configured to detect a refrigerant leak when the (detected) amount of refrigerant detected is above a predetermined minimum concentration (e.g., at or above a lower flammability level, or the like). When refrigerant leak is detected, the air valve 150 is opened. The open air valve 150 fluidly connects the compressor compartment 124 to the blower compartment 126. The operation of the blower 138 suctions leaked refrigerant from the compressor compartment 124 into the blower compartment 126, which is then discharged from the air conditioning unit 100 through the outlet 104.

The air conditioning unit 100 may include a controller 190 that controls operation of the air valve 150. In an embodiment, the controller 190 may be the controller of the air conditioning unit 100. In an embodiment, the controller 190 may be the controller of the refrigerant leak detection system 191. In another embodiment, the controller may be a separate controller provided for operating the air valve 150.

In an embodiment, the air conditioning unit 100 may be configured operate in a first mode and a second mode. In the first mode, the air valve 150 is closed and obstructs air from flowing between the first compartment 124 and the second compartment 126. For example, air conditioning unit 100 is configured to operate normally in the first mode. In the first mode, the air conditioning unit 100 may be configured to also operate in a cooling mode, a heating mode, a ventilation mode, or the like. In the second mode, the air valve 150 is open and the blower 138 is active to discharge any leaked refrigerant present in the first compartment 124 out of the housing 110 through the second compartment 126.

When a refrigerant leak is detected, the controller may be configured to activate the blower 138 (e.g., when the blower 138 is not currently operating). The controller 190 may also be configured to maintain operation of the blower 138 for a predetermined time period (e.g., for at least 5 minutes, for at least 10 minutes, or the like). For example, the predetermined time period can provide ventilation to the compartments 124, 126 according to Standard UL 60335-2-40, clause GG.4 (4th Ed.). In an embodiment, the blower 138 is maintained for the predetermined amount of time after the refrigerant concentration (e.g., as detected via the sensor(s) 192A, 192B, by each of the sensor(s) 192A, 192B) is at or below the predetermined minimum concentration. The controller 190 may be configured to close the air valve 150 after the refrigerant is no longer detected or after the predetermined time period.

In the illustrated embodiment, when the air valve 150 is open, air is able to flow into the compressor compartment 124 through the openings between panels that form the housing 110. Air may also flow through openings that may conventionally be provided in the panels of air conditioning units. In an embodiment, the housing 110 may be provided with one or more openings to allow for air to more easily flow into the compressor compartment 124 from the outside environment.

In an embodiment, the housing 110 may include one or more louvers vents 127 disposed along the compressor compartment 124. The louver vent(s) 127 may allow air to flow into the compressor compartment 124 when air is being suctioned from the compressor compartment 124 via the air valve 150. In one example, the negative pressure caused by suctioning through the air valve 150 may cause the louver vent(s) 127 to open (e.g., to move from closed to open).

In another embodiment, the air valve 150 may be provided in a side 112, 114, 118, 120 of the housing 110 that defines the compressor compartment 124. The opening 129 is provided in the partition 128 as previously discussed, except without the air valve 150. For example, the compressor compartment 124 may be sufficiently air tight to limit or prevent flow through the opening 129 in the partition 128 (e.g., sufficiently air tight from the external environment, sufficiently air tight in the housing 110 along the compressor compartment 124). For example, when the air valve 150 in the housing 110 is closed, a pressure drop of suctioning from the compressor compartment 124 causes little to no air to flow from the compressor compartment 124 into the blower compartment 126. When the air valve 150 in the housing 110 is open, air is allowed to freely flow into the compressor compartment 124, which causes air to flow from the compressor compartment 124 to the blower compartment 126 through the opening 129 in the partition 128. In such an embodiment, the partition 128 may include a louver vent (e.g., louver vent 127 in the partition) for the opening 129 to further limit flow through the opening 129 when the air valve 150 in the housing 110 is closed. For example, the illustrated positon of the louver vent 127 in the housing 110 and the illustrated position of the air valve 150 in the partition 128 in FIG. 3 may be switched in other embodiments.

Figure 4:
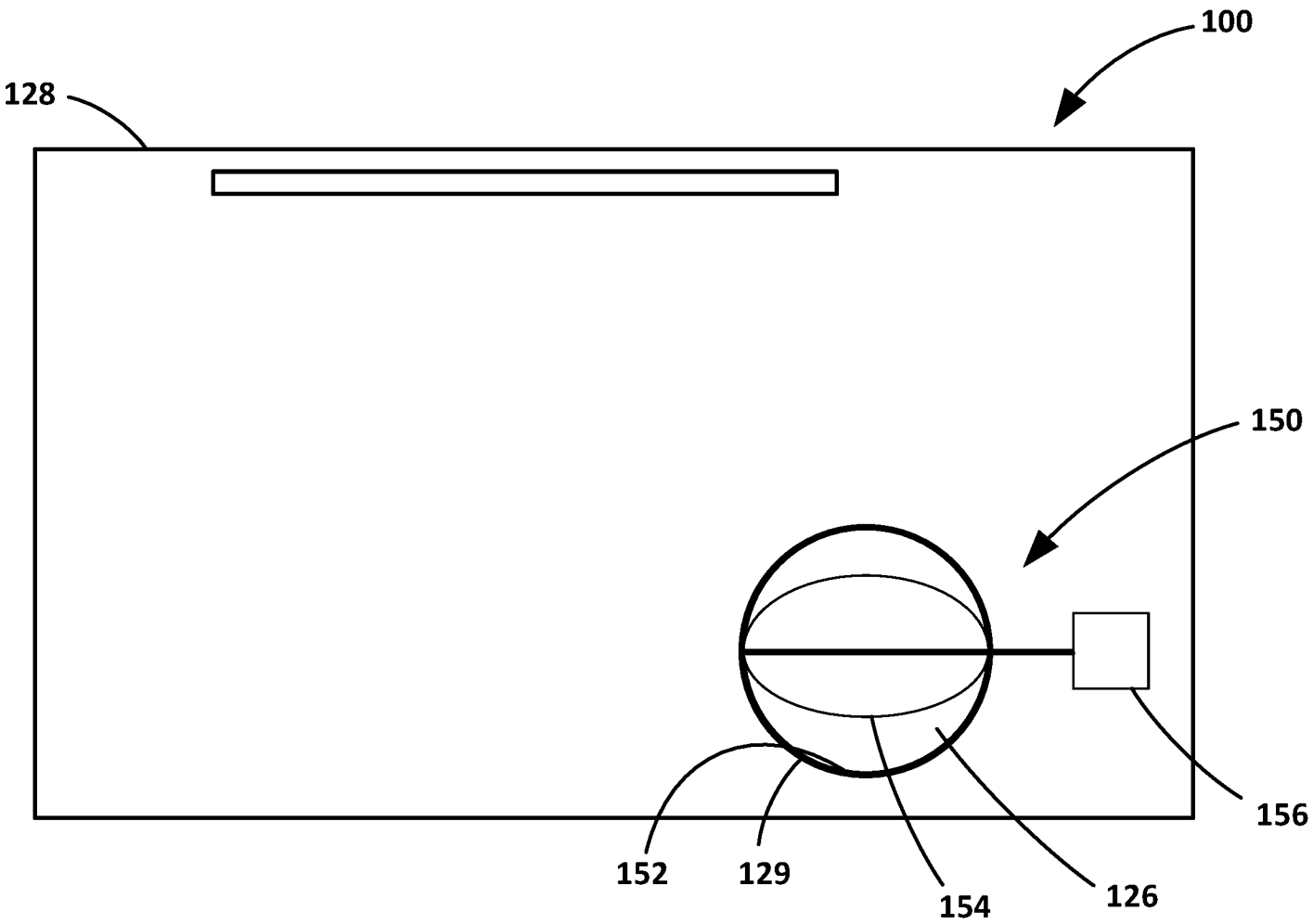
FIG. 4 is a side view of an air valve disposed in a partition of the air conditioning unit in FIG. 3, according to an embodiment.

FIG. 4 is a side view of the air valve 150 in the partition 128, according to an embodiment. The air valve 150 is provided in an opening 129 in the partition 128. In the illustrated embodiment, the air valve 150 includes an electric motor 156. The electric motor 156 is configured to rotate the valve body 154 relative to the partition 128. FIG. 4 shows the valve body 154 in a position tilted towards the viewer. The air valve 150 can be moved to the closed position by being moved to a position in which the valve body 154 blocks the opening in the through the valve housing 152. In an embodiment, the valve housing 152 may be the opening 129 in the partition 128. In another embodiment, the valve housing 152 may be a vent disposed in the opening 129 in the partition.

The air valve 150 and its operation can allow for ventilating leaked refrigerant from the compressor compartment 124 utilizing the blower 138. This can allow for ventilating the compressor compartment 124 without utilizing a second/secondary blower, while generally maintaining the separation between the compressor compartment 124 and the blower compartment. This can advantageously allow for ventilation of the compressor compartment 124 while maintaining the efficiency of the air conditioning unit.

Figure 5:
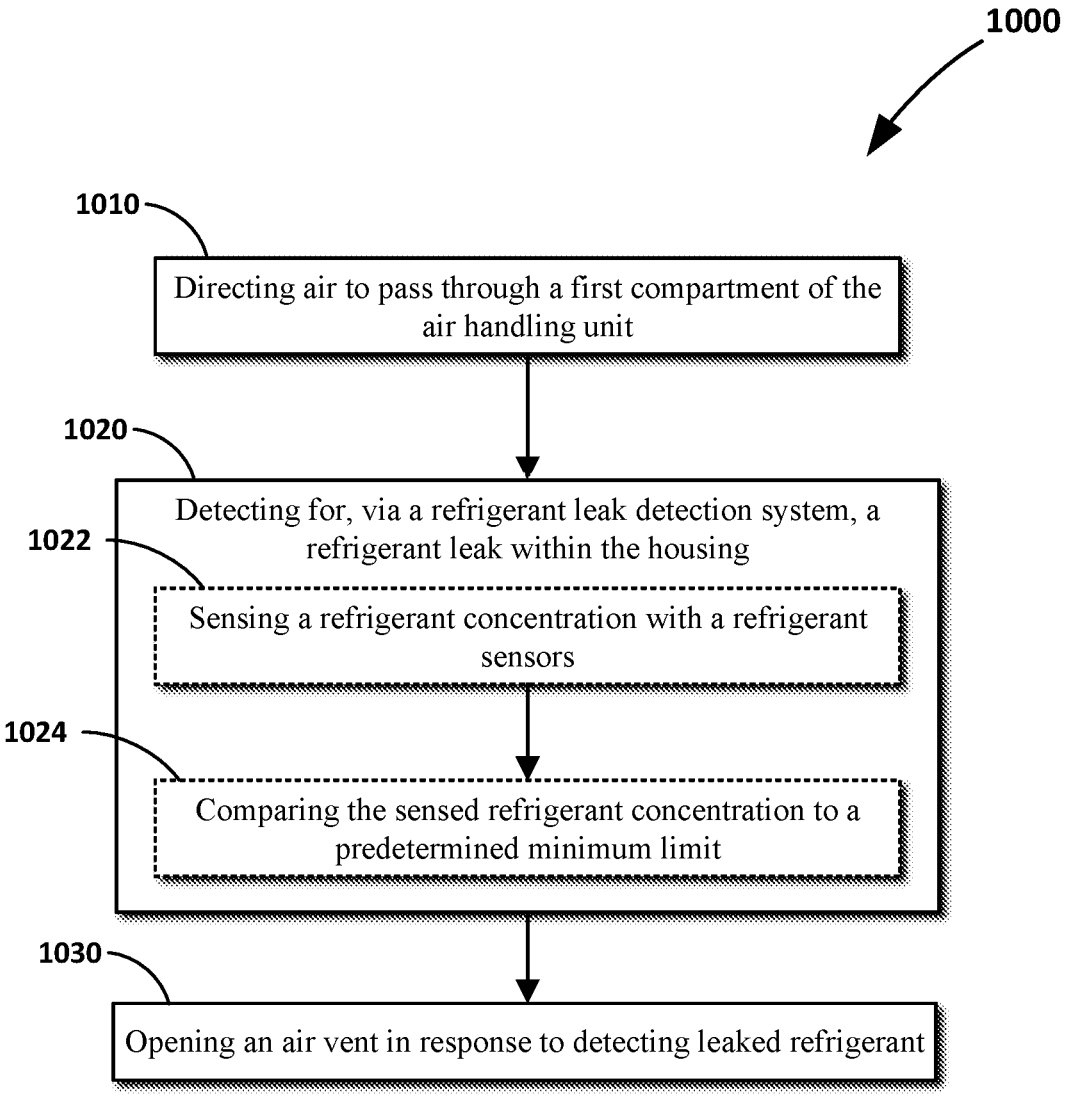
FIG. 5 is a block flow diagram for an embodiment of a method of ventilating an air conditioning unit.

FIG. 5 is a block flow diagram of a method of ventilating an air conditioning unit. For example, the method 1000 may be employed for the ventilating the air conditioning unit 100 in FIGS. 2-4. In an embodiment, the method 1000 may be employed by the controller 190 of the air conditioning unit 100. The method 1000 starts at 1010.

At 1010, air is directed to pass through a first compartment (e.g., first compartment 124, a blower compartment) of a housing (e.g., housing 110) of the air conditioning unit. Directing the air at 1010 can include directing the air to flow through an air heat exchanger (e.g., first heat exchanger 132, an evaporator in a cooling mode). The air is conditioned by the refrigerant as it flows through the air heat exchanger (e.g., cooled by an evaporator in a cooling mode, heated by a condenser in a heating mode). In an embodiment, the air flows into the first compartment by flowing through air conditioner. The directing of the air at 1010 may also include directing air into the housing through an air inlet (e.g., inlet 102) and discharging the conditioned air from the housing an air outlet (e.g., outlet 104). For example, a blower (e.g., blower 138) of the air conditioning system can operate to direct the air to flow into and out of the housing 103. The method 1000 then proceeds to 1020.

At 1020, a refrigerant leak detection system (e.g., refrigerant leak detection system 1010) detects for a refrigerant within the housing of the air conditioning unit. The refrigerant leak detection at 1020 may be based on one or more of performance of the air conditioning system (e.g., detected performance of the conditioning provided by the air conditioning system), on detecting concentration of refrigerant in the air (e.g., directly or indirectly), and the like. The refrigerant leak detection system may include one or more refrigerant leak sensors (e.g., sensor(s) 192A, 192B). A refrigerant leak sensor may be, for example but not limited to, a concentration sensor, a performance sensor, or the like.

For example, in an embodiment, the detecting of the leaked refrigerant at 1020 can include detecting with one or more concentration sensors a refrigerant concentration within the housing (e.g., a concentration of refrigerant in air) at 1022. In an embodiment, the sensing at 1022 can include sensing, with a concentration sensor (e.g., first sensor 192A), a refrigerant concentration in a first compartment within the housing (e.g., first compartment 124, a compressor compartment). In an embodiment, the sensing at 1022 can include sensing, with a concentration sensor (e.g., second sensor 192B) a refrigerant concentration in the second compartment (e.g., second compartment 126, the blower compartment) within the housing.

For example, in an embodiment, the detecting of the leaked refrigerant at 1020 may include detecting with one or more performance sensor(s), a performance of the air conditioning unit. Detecting the performance of the air conditioning unit may include detecting, with the one or more performance sensors, one or more operating conditions of the air conditioning unit. Operating conditions may include, but are not limited to, inlet air temperature, conditioned air discharge temperature, compressor discharge pressure, refrigerant temperature(s) (e.g., inlet and/or outlet temperature(s) of the refrigerant at one or more of the components of the refrigerant circuit 108), valve position (e.g., position of the expander 134), or the like.

The detecting for a leaked refrigerant at 1020 can also include comparing the detected refrigerant concentration (e.g., detected at 1022) to a predetermined minimum limit at 1024. For example, the leaked refrigerant is detected at 1020 when a detected refrigerant concentration is at or above the predetermined minimum limit. For example, when a detected refrigerant concentration is less than the predetermined minimum limit, no leaked refrigerant is detected. The method 1000 may then proceed to 1030.

At 1030, an air valve (e.g., air valve 150) is opened in response to the detecting of leaked refrigerant. The opening of the air valve at 1030 is configured to ventilate at least the compressor compartment within the housing.

In an embodiment, the blower may not be operating when leaked refrigerant is detected. In such an embodiment, the method 1030 may include the operation of blower at 1010 as a response to detecting the leaked refrigerant, in addition to or in alternative to 1010.

It should be appreciated that the method 1000 in other embodiments may be modified to include features as discussed above with respect to the air conditioning unit 100 in FIGS. 1-4. For example, the method 1000 in an embodiment may include a first mode (e.g., a normal operation mode) that includes 1010 for operating to cool air, and a second mode that includes 1020 and 1030 for ventilating the blower compartment in response to a detected refrigerant leak (e.g., a refrigerant leak ventilation mode).

Figure 6:
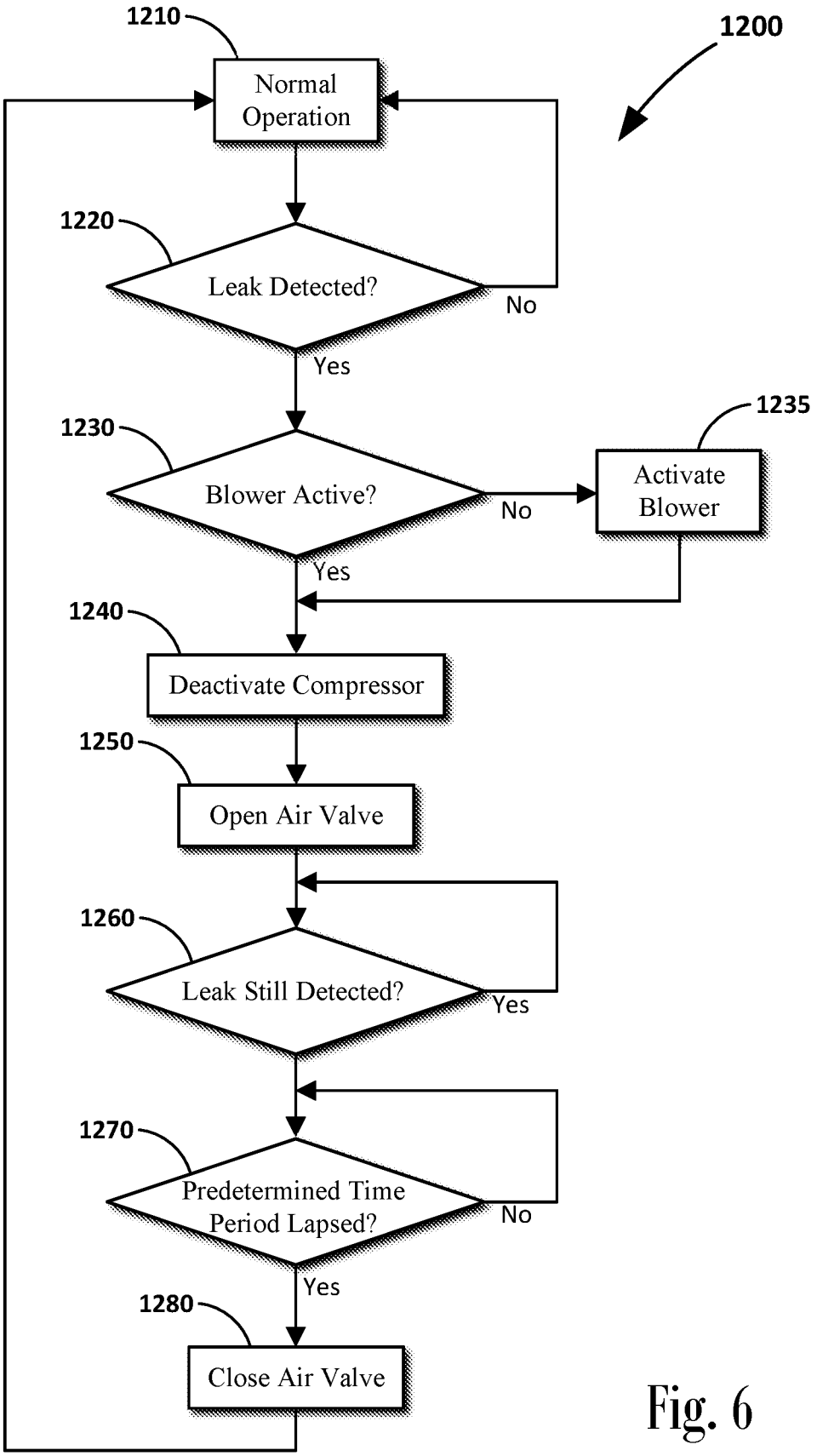
FIG. 6 is a block flow diagram for an embodiment of a method of ventilating an air conditioning unit.

FIG. 6 is a block flow diagram of a method 1200 of ventilating an air conditioning unit. For example, the method 1200 may be employed for the ventilating the air conditioning unit 100 in FIGS. 2-4. In an embodiment, the method 1200 may be employed by the controller 190 of the air conditioning unit 100. The method 1200 starts at 1210.

At 1210, the air conditioning unit is operated normally. For example, at 1210, the operation of the air conditioning unit is not modified/changed based on detecting a refrigerant leak. Normal operation may include, for example, operating in a conditioning mode (e.g., a heating mode, a cooling mode, or the like), a ventilation mode, an off mode, or the like. In the conditioning mode, air is suctioned into the air conditioning unit, conditioned within the air conditioning unit, and the conditioned air is discharged from the air conditioning unit (e.g., as discussed for the air conditioning unit 100 in FIGS. 2-4). In a ventilation mode, air is suctioned into and then discharged from the air conditioning unit without being conditioned. In an off mode, the air conditioner is turned off (e.g., no conditioning or ventilation currently needed). The method 1200 then proceeds to 1220.

At 1220, the air conditioning unit detects for a refrigerant leak within a housing (e.g., housing 110) of the air conditioner. For example, a refrigerant detection system (e.g., refrigerant detection system 191) detects for a refrigerant leak. In an embodiment, the refrigerant leak detection 1220 in FIG. 6 may be similar to the refrigerant leak detection 1020 in FIG. 5 as discussed above. When no refrigerant leak is detected at 1220, the method 1200 proceeds back to 1210 (e.g. the air conditioning unit continues normal operation). When a refrigerant leak is detected at 1220, the method 1200 proceeds to 1230.

At 1230, when a blower (e.g., blower 138) of the air conditioning unit is not active (e.g., the blower is turned off/not currently operating), the method 1200 proceeds to 1235. At 1235, the blower is activated, and the method 1200 then proceeds to 1240. At 1230, when the blower is active (e.g., is already operating to direct air through the housing), the method 1200 proceeds from 1230 to 1240.

At 1240, a compressor (e.g., compressor 130) of the air conditioning unit is deactivated. For example, deactivating the compressor 1240 may include preventing operation of the compressor 1240 (e.g., stopping current operation, preventing future operation while the refrigerant leak is still detected). For example, deactivating the compressor 1240 may include no longer supplying electrical power to the compressor 1240. The method 1200 then proceeds to 1250.

At 1250, an air valve (e.g., air valve 150) of the air conditioning unit is opened. In an embodiment, opening of the air valve 1250 in FIG. 6 may be similar to the opening of the air valve at 1030 in FIG. 5 as discussed above. The method 1200 then proceeds to 1260.

At 1260, the air conditioning unit detects for the refrigerant leak. For example, at 1260, the it is determined whether the housing has been ventilated such that the refrigerant leak is no longer detected. In an embodiment, the detection of the refrigerant leak at 1260 may be a continuation of the same refrigerant leak detection performed at 1220 (e.g., the refrigerant leak detection continues while 1230-1250 occur). When the refrigerant leak is still detected at 1260, the method 1200 continues its detecting at 1260. When the refrigerant leak is not detected at 1260, the method 1200 proceeds to 1270. For example, the method 1000 does not proceed from 1260 to 1270 until the refrigerant leak is no longer detected.

At 1270, after a predetermined time period has occurred since not detecting a refrigerant leak, the method 1200 proceeds to 1280. In an embodiment, if a refrigerant leak is detected during the time period at 1270 (after detecting no refrigerant leak), the method 1200 can proceed back to 1260.

At 1280, the air valve is closed. The method 1200 then proceeds back to 1210. At 1210, the air conditioning unit is operated normally. For example, the air conditioning unit can return to operating in the same manner as previous to detecting a refrigerant leak at 1220 (e.g., previous to 1230). In an embodiment, the air conditioning unit may modify operation after the refrigerant leak is detected (e.g., proceed to a modified normal operation).

It should be appreciated that the method 1200 in FIG. 6 in other embodiments may be modified to have features as discussed herein for the air conditioning unit in FIGS. 2-4 and/or for the method 1000 in FIG. 5. It should also be appreciated that the method 1200 in FIG. 6 in other embodiments may be modified to omit or combine one or more of 1220-1280 as shown in FIG. 6.

Aspects

Any of Aspects 1-11 may be combined with any of Aspects 12-18.

Aspect 1. An air conditioning unit, comprising:

a housing including a first compartment and a second compartment, a partition disposed in the housing, the partition separating the first compartment and the second compartment;

a refrigerant circuit including a compressor disposed in the first compartment;

a blower configured to direct air to flow through the second compartment;

an air valve extending through the partition or through the housing to the second compartment; and a refrigerant leak detection system configured to detect a refrigerant leak within the air conditioning unit, a controller configured to open the air valve in response to the refrigerant leak detection system detecting the refrigerant leak.

Aspect 2. The air conditioning unit of Aspect 1, wherein the refrigeration circuit includes a first heat exchanger disposed in the second compartment, the first heat exchanger configured to condition the air flowing through the first compartment.

Aspect 3. The air conditioning unit of any one of Aspects 1 and 2, wherein the refrigerant leak detection system is configured to detect a concentration of refrigerant and to detect the refrigerant leak when a concentration of refrigerant is at or above a predetermined minimum limit.

Aspect 4. The air conditioning unit of any one of Aspects 1-3, wherein the air valve extends through the partition.

Aspect 5. The air conditioning unit of any one of Aspects 1-3, wherein the air valve extends through the housing to the second compartment.

Aspect 6. The air conditioning unit of any one of Aspects 1-5, wherein the controller is configured to in response to detecting the leaked refrigerant, open the air valve and activate the blower.

Aspect 7. The air conditioning unit of any one of Aspects 1-6, wherein the opening of the air valve causes the blower to suction air from the first compartment into the second compartment.

Aspect 8. The air conditioning unit of Aspect 7, wherein the suction by the blower mixes the air from the first compartment with inlet air flowing through the second compartment through a first heat exchanger, and the blower is configured to discharge the mixture through an outlet in the housing.

Aspect 9. The air conditioning unit of any one of Aspects 1-8, wherein the controller is configured to operate the air conditioning unit in at least:

a first mode, in which the air valve is closed and obstructs air from flowing between the first compartment and the second compartment, and a second mode, in which the air valve is open and the blower is active to discharge any leaked refrigerant present in the first compartment out of the housing through the second compartment.

Aspect 10. The air condonation unit of Aspect 9, wherein in the first mode, the first heat exchanger conditions inlet air directed through the second compartment by the blower.

Aspect 11. The air conditioning unit of any one of Aspects 1-10, wherein the air valve is one of a butterfly valve, a gate valve, and an umbrella valve.

Aspect 12. A method of ventilating an air conditioning unit, comprising:

directing, with a blower, air to pass through a blower compartment of a housing of the air conditioning unit, which includes the air flowing into the blower compartment through a first heat exchanger, wherein the housing includes a compressor compartment containing a compressor and the blower compartment containing the blower and the first heat exchanger, a partition disposed in the housing that separates the compressor compartment and the blower compartment;

detecting, via a refrigerant leak detection system, for a refrigerant leak within the air conditioning unit; and in response to detecting the refrigerant leak, opening an air valve that one of extends through the partition or through the housing to the compressor compartment.

Aspect 13. The method of Aspect 12, further comprising:

suctioning, with the blower, any present leaked refrigerant in the compressor into the blower compartment;

discharging, with the blower, a mixture of the air after flowing through the first heat exchanger and the leaked refrigerant suctioned into the second compartment out of the air conditioning unit.

Aspect 14. The method of any one of Aspects 12 and 13, wherein the detecting, via refrigerant leak detection system, for the refrigerant leak includes:

sensing, with the one or more concentration sensors, a refrigerant concentration within the housing of the air conditioning unit; and detecting the leaked refrigerant when the sensed refrigerant concentration is at or above a predetermined minimum limit.

Aspect 15. The method of any one of Aspects 12-14, wherein the air valve is disposed in the opening in the partition.

Aspect 16. The method of any one of Aspects 12-14, wherein the air valve is disposed in the partition.

Aspect 17. The method of any one of Aspects 12-16, further comprising:

operating the air conditioning unit in a first mode, in which in which the air valve is closed and the first heat exchanger conditioning the air passing through the first heat exchanger;

operating the air conditioning unit in a second mode, in which the air valve is open and that includes activating the blower to discharge any leaked refrigerant present in the first compartment out of the housing through the second compartment.

Aspect 18. The method of any one of Aspects 12-17, wherein the directing, with the blower, of the air to pass through the second compartment is in response to detecting the leaked refrigerant.

The terminology used herein is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components. In an embodiment, "connected" and "connecting" as described herein can refer to being "directly connected" and "directly connecting".

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. An air conditioning unit for conditioning a climate controlled space, comprising:

a housing including a first compartment and a second compartment, a partition disposed in the housing, the partition separating the first compartment and the second compartment;

a refrigerant circuit including a compressor disposed in the first compartment and a first heat exchanger disposed in the second compartment;

a blower configured to direct air to flow through the second compartment from an inlet to an outlet, the first heat exchanger configured to condition the air flowing through the second compartment, the air conditioned by the first heat exchanger being provided from the outlet to the climate controlled space;

an air valve extending through the partition or through the housing to the second compartment; and a refrigerant leak detection system configured to detect a refrigerant leak within the air conditioning unit, a controller configured to open the air valve in response to the refrigerant leak detection system detecting the refrigerant leak;

wherein the opening of the air valve causes the blower to suction air from the first compartment into the second compartment.

2. The air conditioning unit of claim 1, wherein the refrigerant leak detection system is configured to detect a concentration of refrigerant and to detect the refrigerant leak when the concentration of refrigerant is at or above a predetermined minimum limit.

3. The air conditioning unit of claim 1, wherein the air valve extends through the partition.

4. The air conditioning unit of claim 1, wherein the air valve extends through the housing to the second compartment.

5. The air conditioning unit of claim 1, wherein the controller is configured to in response to detecting the refrigerant leak, open the air valve and activate the blower.

6. The air conditioning unit of claim 1, wherein the suction by the blower mixes the air from the first compartment with the air flowing from the inlet through the second compartment through the first heat exchanger, and the blower is configured to discharge the mixture through the outlet in the housing.

7. The air conditioning unit of claim 1, wherein the controller is configured to operate the air conditioning unit in at least:

a first mode, in which the air valve is closed and obstructs air from flowing between the first compartment and the second compartment, and a second mode, in which the air valve is open and the blower is active to discharge any leaked refrigerant present in the first compartment out of the housing through the second compartment.

8. The air conditioning unit of claim 7, wherein in the first mode, the first heat exchanger conditions the air directed through the second compartment by the blower.

9. The air conditioning unit of claim 1, wherein the air valve is one of a butterfly valve, a gate valve, and an umbrella valve.

10. The air conditioning unit of claim 1, wherein the air conditioning unit includes a cooling mode for cooling the climate controlled space, and the first heat exchanger in the cooling mode configured to operate as an evaporator that cools the air flowing through the first compartment.

11. A method of ventilating an air conditioning unit for conditioning a climate controlled space, comprising:

directing, with a blower, air to pass through a blower compartment of a housing of the air conditioning unit from an inlet to and outlet of the blower compartment, which includes the air flowing into the blower compartment through a first heat exchanger and being conditioning by the first heat exchanger, wherein the air conditioned by the first heat exchanger is provided from the outlet to the climate controlled space, wherein the housing includes a compressor compartment containing a compressor and the blower compartment containing the blower and the first heat exchanger, a partition disposed in the housing that separates the compressor compartment and the blower compartment;

detecting, via a refrigerant leak detection system, for a refrigerant leak within the air conditioning unit; and in response to detecting the refrigerant leak, opening an air valve that extends through the partition;

suctioning, with the blower, any present leaked refrigerant in the compressor compartment into the blower compartment;

discharging, with the blower, a mixture of the air after flowing through the first heat exchanger and the leaked refrigerant suctioned into the blower compartment out of the air conditioning unit.

12. The method of claim 11, wherein the detecting, via the refrigerant leak detection system, for the refrigerant leak includes:

sensing, with one or more concentration sensors, a refrigerant concentration within the housing of the air conditioning unit; and detecting the refrigerant leak when the sensed refrigerant concentration is at or above a predetermined minimum limit.

13. The method of claim 11, wherein the air valve is disposed in an opening in the partition.

14. The method of claim 11, further comprising:

operating the air conditioning unit in a first mode, in which the air valve is closed and the first heat exchanger is conditioning the air passing through the first heat exchanger;

operating the air conditioning unit in a second mode, in which the air valve is open and that includes activating the blower to discharge any leaked refrigerant present in the compressor compartment out of the housing through the blower compartment.

15. The method of claim 11, wherein the directing, with the blower, of the air to pass through the blower compartment is in response to the detecting of a refrigerant leak.

* * * * *